United States Patent [19]

Melin

[11] Patent Number: 4,753,255

[45] Date of Patent: Jun. 28, 1988

[54] CLOSURE APPARATUS FOR ROTATING OPEN TOP CONTAINER

[75] Inventor: Gerald W. Melin, Stanchfield, Minn.

[73] Assignee: Finishing Equipment, Inc., St. Paul, Minn.

[21] Appl. No.: 44,653

[22] Filed: May 1, 1987

[51] Int. Cl.[4] ..... B08B 3/04

[52] U.S. Cl. ..... 134/52; 134/66; 134/76; 134/135; 134/157; 198/344; 198/346.3; 118/418; 118/423

[58] Field of Search ..... 134/66, 76, 135, 44, 134/52, 58 R, 68, 133, 135, 137, 140, 143, 157; 118/418, 423; 414/225; 198/339.1, 343, 344, 346, 346.1, 346.3

[56] References Cited

U.S. PATENT DOCUMENTS

| | | | |
|---|---|---|---|
| 2,099,121 | 11/1937 | Kivley | 134/76 X |
| 2,417,472 | 3/1947 | Dorff | 118/423 X |
| 3,910,297 | 10/1975 | Pinknam | 134/76 |
| 4,252,229 | 2/1981 | Corbett | 134/76 X |

FOREIGN PATENT DOCUMENTS

| | | | |
|---|---|---|---|
| 2013122 | 3/1970 | France | 134/66 |
| 914439 | 3/1982 | U.S.S.R. | 134/76 |

*Primary Examiner*—Harvey C. Hornsby
*Assistant Examiner*—Frankie L. Stinson
*Attorney, Agent, or Firm*—Kinney & Lange

[57] ABSTRACT

A basket for tumbling workpieces is positioned in a carrier. The carrier is rotatably mounted on a carrier rotation axis between two legs of a stage assembly and is rotated by a carrier rotation motor mounted on the stage assembly. A basket cover supported on the carrier is driven between open and closed position with respect to the carrier mounted basket by a container cover drive motor mounted on the stage assembly, a double-acting lead screw shaft rotatably supported in the carrier in parallel relation to the carrier rotation axis, a drive train between the lead screw shaft and the basket cover, and a drive train, including sprockets rotatable on the carrier rotation axis, between the cover drive motor and the lead screw shaft.

12 Claims, 5 Drawing Sheets

32
32
22
111
117
88
86
87
93
95
89
92
24
90
91
94
27
26
112
113
116
114
3
3
109
69
75
74
76
70
62
68
78
40
71
69
80
107
96
106
53
44
50
79
60
55
48
48
82
43
105
46
45
50
52
42
57
56
58
54
18
58
64
66
100
66
84
64
20

10
12
14
15
16
16
18
20
22
22
24
27
30
32
34
36
40
86
100
102
103
106
107

62
70
68
75
40
74
74
78
78
79
76
64
60
50
63
42
18
82
44
103
102
100
84
66
20

CLOSURE APPARATUS FOR ROTATING OPEN TOP CONTAINER

BACKGROUND OF THE INVENTION

1. Field of the Invention

This invention has relation to baskets or other containers which are rotated so that many relatively small workpieces inside are tumbled over and over during processing, and particularly to apparatus which automatically positively positions a cover on such a rotatable container, maintains it in position against the force of the weight of the workpieces being tumbled, and automatically separates the cover from the container after the workpieces have been processed so that the container can be automatically removed and replaced with a container loaded with unprocessed workpieces.

2. Description of the Prior Art

It is known to manually fasten rotatable basket covers in place using various combinations of nuts and bolts or the like. Such methods positively hold the cover in place against the weight of workpieces being processed; but have the disadvantage that an attendant must be on hand to fasten and unfasten the cover. This takes time that is lost "down time" as far as operation of the processing equipment is concerned. Also, the point where this manual fastening and unfastening of the cover is done must be a point accessible to such attendant. This can be grossly inefficient as concerns layout of the processing line.

It is known to automatically or manually move a cover into place on such a rotatable basket using an overcenter spring action with reliance on the strength of the spring to hold the cover in place on the rotatable basket against weight of the workpieces. The disadvantages of the manual operation of such an apparatus are as set out above. Additionally, the weight of the workpieces which can be processed in such a basket is limited by the strength of the spring holding the cover in place. As the strength of the spring is increased, the difficulty in snapping the cover between its open and closed conditions is increased, and more time and/or force is required to accomplish this movement either manually or automatically.

When loading workpieces into a basket, it is not practical to anticipate the load size which will cause such a spring loaded cover to open. Overloading results in release of the tumbling workpieces into the processing equipment. This causes, at least, considerable down time to retrieve the workpieces and, all too often, damage to the processing equipment, contamination and/or loss of any processing fluids, and/or destruction or damage to the workpieces.

What was needed before the present invention was an apparatus which would automatically and positively move a basket cover from its open position in spaced relation to a rotatable basket to its closed position in positive contact with the basket as soon as the basket was positioned inside of a rotatable carrier; and which would automatically move such cover from its positive closed position to an open position as soon as the workpiece processing sequence has been completed, and the carrier had come to rest.

SUMMARY OF THE INVENTION

Closure apparatus for a rotatable open top basket or other container containing workpieces to be processed is for use with a container cover and with a carrier which encompasses the container and is mounted on a carrier rotation axis between two parallel legs of a stage assembly or the like, and is rotated on that axis by carrier rotation drive means supported on the stage assembly.

The improvement presented by this invention includes a cover and cover positioning means for positively positioning the cover on the open top container when the container is positioned within the carrier, and for separating the cover from the container after the workpieces have been processed. The apparatus of the invention includes a cover operating shaft rotatably supported in the carrier to be in parallel, spaced relation to the carrier rotation axis and to be in position above and spaced from the open top container when supported in the carrier at rest. There are means supporting the container cover for movement between a first closed position in closing relation to the top of the container and a second open position in spaced relation to the container; and there are means for moving the container cover between the first closed and the second open positions responsive to rotation of the cover operating shaft in a first angular direction and in a second angular direction, respectively.

This container cover moving means includes a container cover drive motor means and a cover motor drive shaft mounted to the stage assembly, and includes a drive train between the cover motor drive shaft and the cover operating shaft. This drive train includes intermediate cover operating shaft drive sprocket means concentrically mounted with respect to the carrier rotation axis.

The container cover drive motor means is selectively operable to rotate the cover motor drive shaft in direction to rotate the cover operating shaft in the first angular direction to move the container cover toward its closed position and in the second angular direction to move the container cover toward its open position.

In the form of the invention as shown, the container cover motor drive means includes a cover drive motor, a slip clutch between it and the cover motor drive shaft and there is a cover drive motor brake. After the cover drive motor has moved the cover into its first closed position, the electric power to the motor is cut off and the brake is set. As the container and carrier rotate, the clutch will slip and the placement of the right and left handed lead screws will be such that torque will still be applied to positively hold the cover in place.

DETAILED DESCRIPTION OF THE PREFERRED EMBODIMENTS

Figure 1:
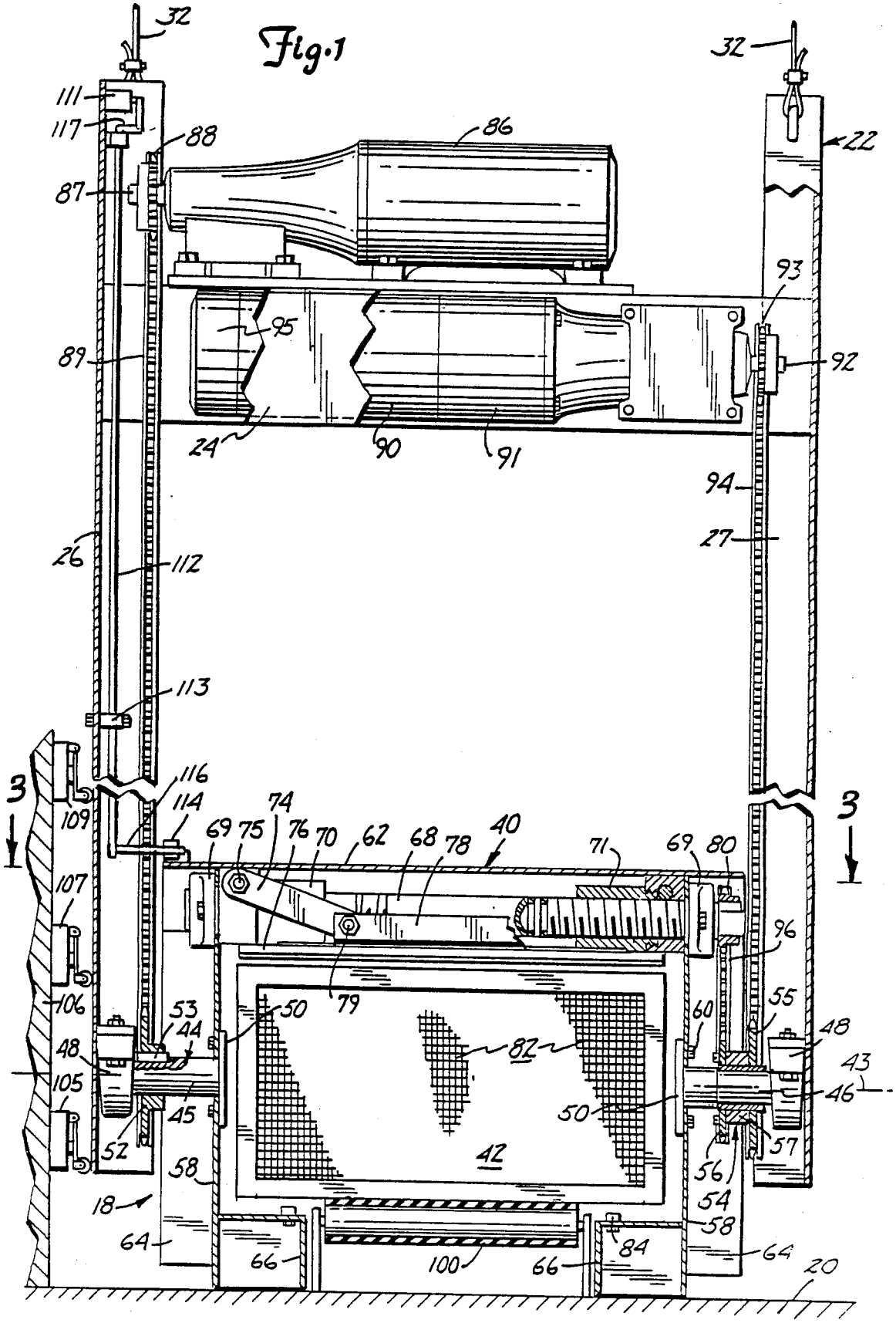
FIG. 1 is a front elevational view with parts in section and parts broken away of a closure apparatus of the present invention shown with an open top basket or container encompassed by a rotatable carrier which is rotatably supported with respect to two parallel vertical legs of a stage assembly.

A treatment tank 10 is supported on a basement floor 12 and encompasses a first vat 14 and a second vat 15 each containing a treatment fluid 16. A loading and unloading station 18 is situated on a ground floor 20. A stage assembly 22 includes an upper stage frame 24 from which a first vertical stage assembly leg 26 and a second vertical stage assembly leg 27 depend. Stage assembly 22 is supported from a stage assembly trolley 30 by elevator lines 32,32, and the elevation of the stage assembly is controlled by reeling in and out on these elevator lines by a power driven winch within the trolley 30 (not specifically shown). The trolley itself is supported from horizontal tracks 34 which are attached to a ceiling 36 in any usual or preferred manner.

The means of moving the trolley 30 along tracks 34 and of elevating and lowering the stage assembly 22 are not specifically shown. Details of such a structure are shown in U.S. Pat. No. 3,896,829 granted to Sabataka in July of 1975.

A carrier 40 for encompassing and rotating a basket of other container 42 is rotatably supported on a carrier rotation axis 43 by carrier mounting shaft means 44 with respect to first and second vertical stage assembly legs 26 and 27, respectively. This carrier mounting shaft means 44 includes stub shafts 45 and 46 each rotatably mounted in one of a pair of pillow block bearings 48,48. These pillow blocks are each fixedly mounted with respect to a lower portion of one of the stage assembly legs 26 and 27. Each of the stub shafts 45 and 46 is provided with an integral carrier attachment flange 50. A carrier rotation driven sprocket 52 is keyed to a first of the stub shafts 45 as at 53. An intermediate lead screw drive means or lead screw drive sprocket means 54 is mounted on and is freely rotatable with respect to the second stub shaft 46, and consists of a cover motor driven sprocket 55 and a lead screw drive sprocket 56, both concentric with carrier mounting shaft means 44, and internally connected to each other through a collar 57.

The carrier 40 includes a pair of parallel, spaced-apart, vertical side walls 58,58, each fixedly mounted with respect to carrier mounting shaft means 44 by being bolted to one of the carrier attachment flanges 50 as at 60. The carrier is also provided with a top wall or hood 62 integrally fabricated to side walls 58,58 and extending beyond them. Two mutually parallel spaced-apart vertical front walls 63,63 lying in a common plane with each other, and two spaced-apart back walls 64,64 lying in a common plane with each other and each parallel to the front walls 63,63 are each integral with one of the side walls 58 or 58 and are integral with and extend downwardly from the top wall or hood 62 outwardly from the side walls. Box-like transversely extending feet 66,66 are integral with and each extends inwardly from a bottom portion of one of the carrier side walls 58,58 toward the other.

A cover operating shaft such as a dobule-acting screw shaft 68 is freely rotatably mounted in a pair of flange bearings 69,69. One of these bearings is mounted to the outer surface of each of the side walls 58,58 immediately below the hood 62. Openings are provided in each of the walls 58,58 to receive the shaft 68. A pair of trunnion-nut assemblies 70 and 71 are carried on the lead screw shaft 68, one to accommodate the left-hand threads of the double-acting lead screw shaft 68 and the other to accommodate the right-hand threads of that shaft.

Figure 3:
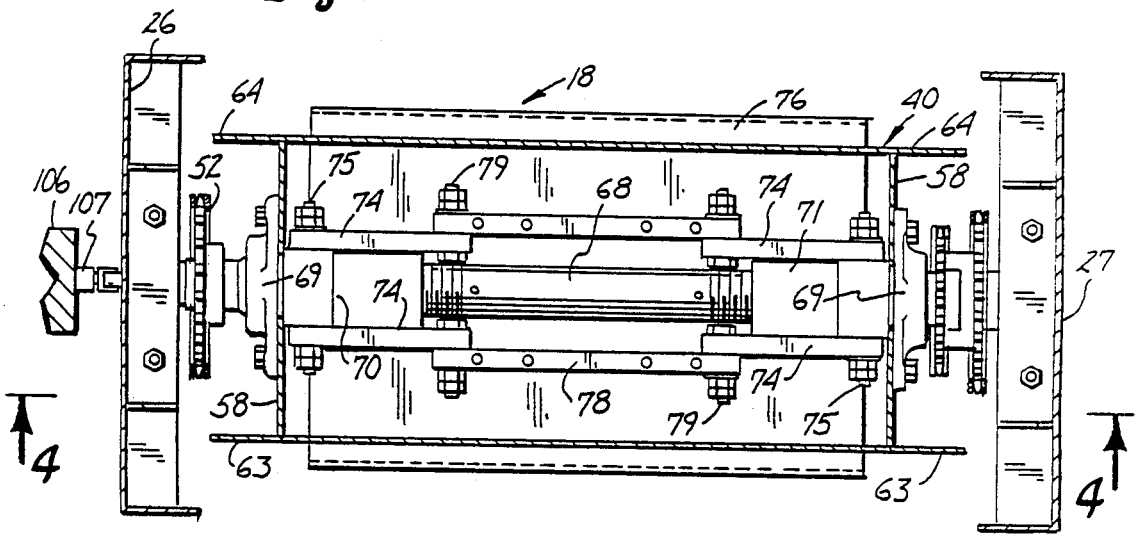
FIG. 3 is a horizontal sectional view taken on the line 3—3 in FIG. 1.
Figure 4:
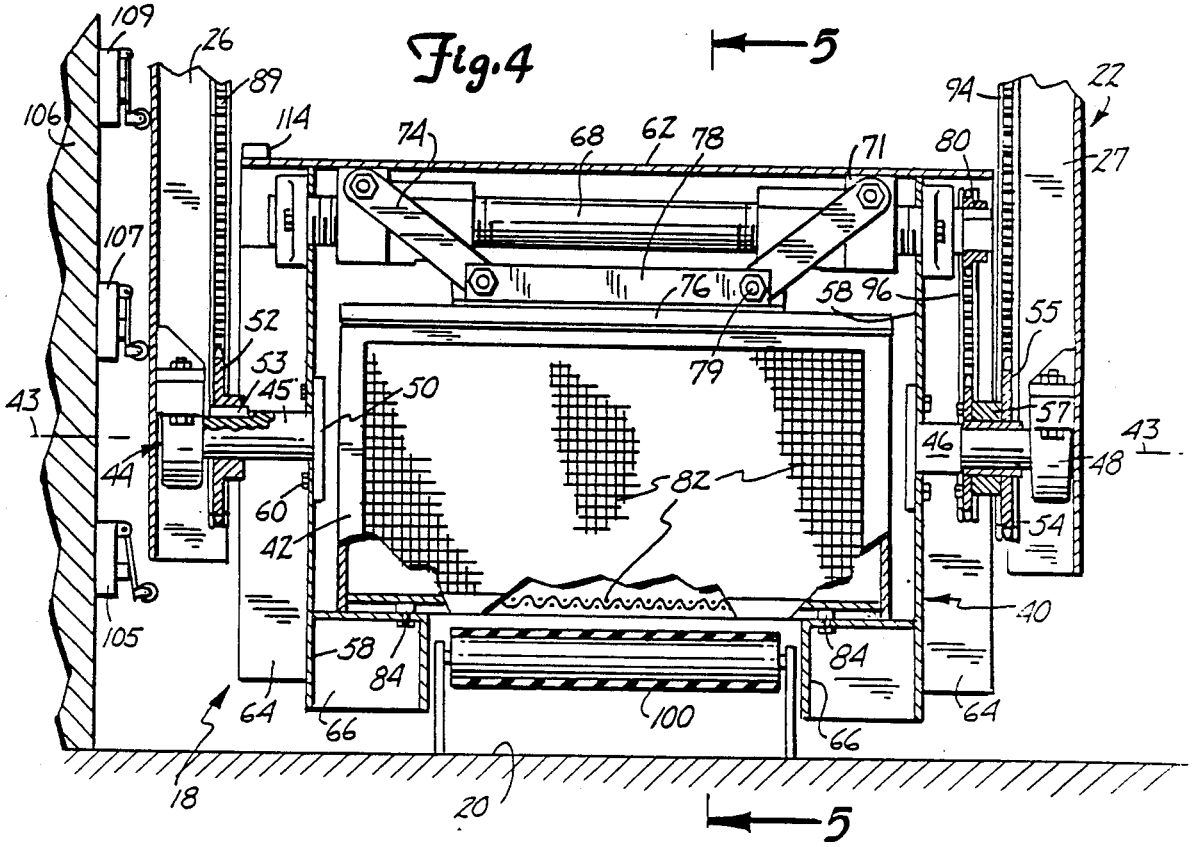
FIG. 4 is a fragmentary vertical sectional view similar to the bottom part of FIG. 1; but taken on line 4—4 in FIG. 3 and showing the basket supported by the carrier with the basket cover in its closed condition and the stage assembly as it would appear just as it started in its upward movement.

Four clamp links 74 are pivoted to the trunnions of the trunnion-nut assembles, two to assembly 70 and two to assembly 71 as at 75. These four links 74 support a container cover or basket cover 76 through the instrumentality of cover brackets 78,78 which extend integrally upwardly from that cover; and through the instrumentality of trunnion pins 79 which pivotally support lower ends of the clamp links 74 in the cover brackets. A lead screw drive sprocket 80 is keyed to an extension of the lead screw shaft on the right side of the right flange bearing 69 as seen in FIGS. 1, 3 and 4. The container or basket 42 is, in the form of the invention as shown, rectilinear in configuration and is provided with openings to allow the passage of fluid through all four sides and the bottom. As shown, these openings are provided by hardware cloth or other wire mesh 82. The container or basket has an open top to allow a quantity of individual pieces of work product (not shown) to be loaded into it for processing and to be removed from it after such processing.

Figure 5:
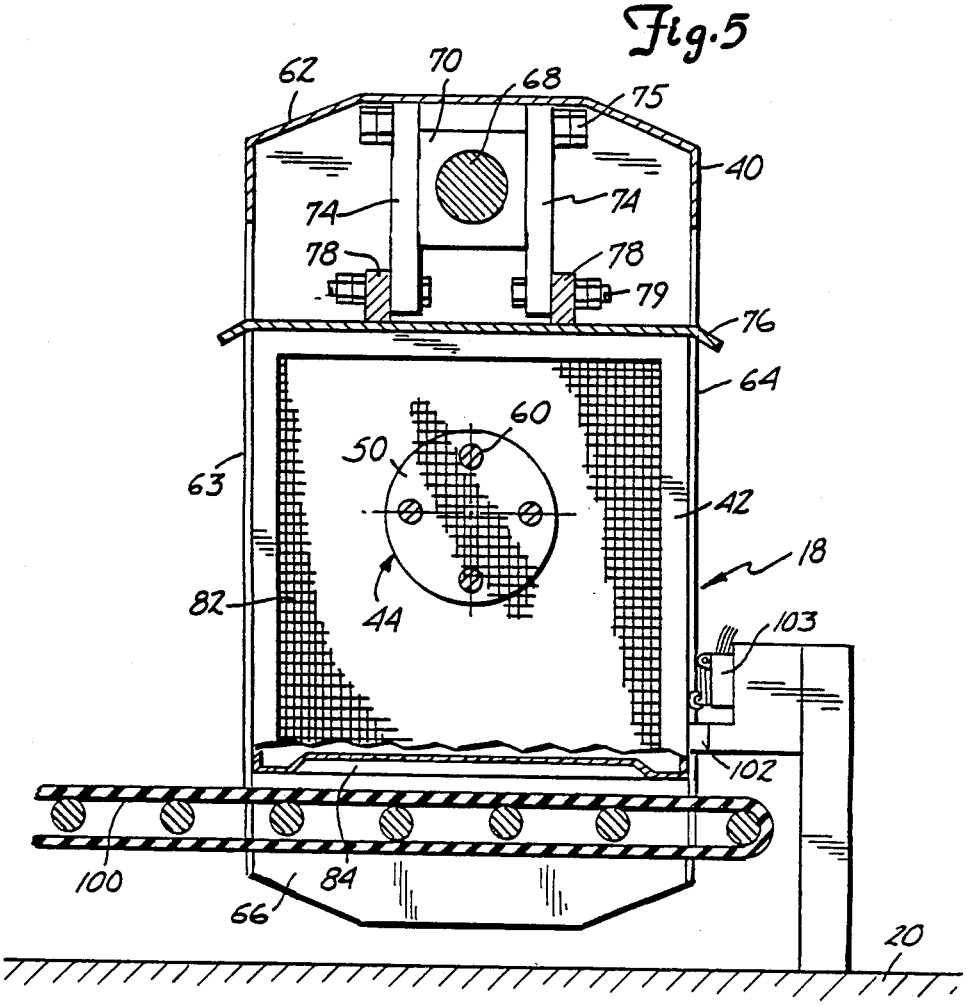
FIG. 5 is an enlarged vertical sectional view of the basket and carrier taken on the line 5—5 in FIG. 3 with the basket shown in full but with parts in section and parts broken away.

As seen in FIGS. 1, 4 and 5, a pair of basket or container wedges 84,84 extend upwardly from the transversely extending feet 66,66 and serve to contact the bottom surfaces of the container or basket 42 to positively and precisely position the container against horizontal movement with respect to those feet both before or after the container cover 76 is fixedly clamped into place.

A carrier rotation drive motor 86 is mounted to the upper stage frame 24 and a carrier rotation drive shaft 87 extends outwardly from that motor and carries a carrier rotation drive sprocket 88. In the form of the invention as shown, the drive train between the carrier rotation drive motor 86 and the carrier rotation driven sprocket 52 is completed by a carrier rotation drive chain 89.

Also carried by the upper stage frame 24 is a container or basket cover drive motor 90, a slip clutch 91, and a cover motor drive shaft 92 to which a first cover drive sprocket 92 is fixedly mounted. A cover drive motor brake 95 adapted to lock the motor against rotation is situated at one end of motor 90 opposite the slip clutch 91.

The basket cover drive motor 90 begins to rotate. At that point the motor stops, the brake locks the motor and the slip clutch 91 slips to continue to apply torque to the cover motor drive shaft 92 as the carrier rotates in direction to tend to hold the shaft cover in its closed position.

A drive train from the cover motor drive shaft 92 to the lead screw driven sprocket 80 includes a first cover drive chain 94, intermediate lead screw drive means 54 freely rotatably mounted on stub shaft 45, and a second cover drive chain 96 between the lead screw drive means 54 and the lead screw driven sprocket 80.

Figure 2:
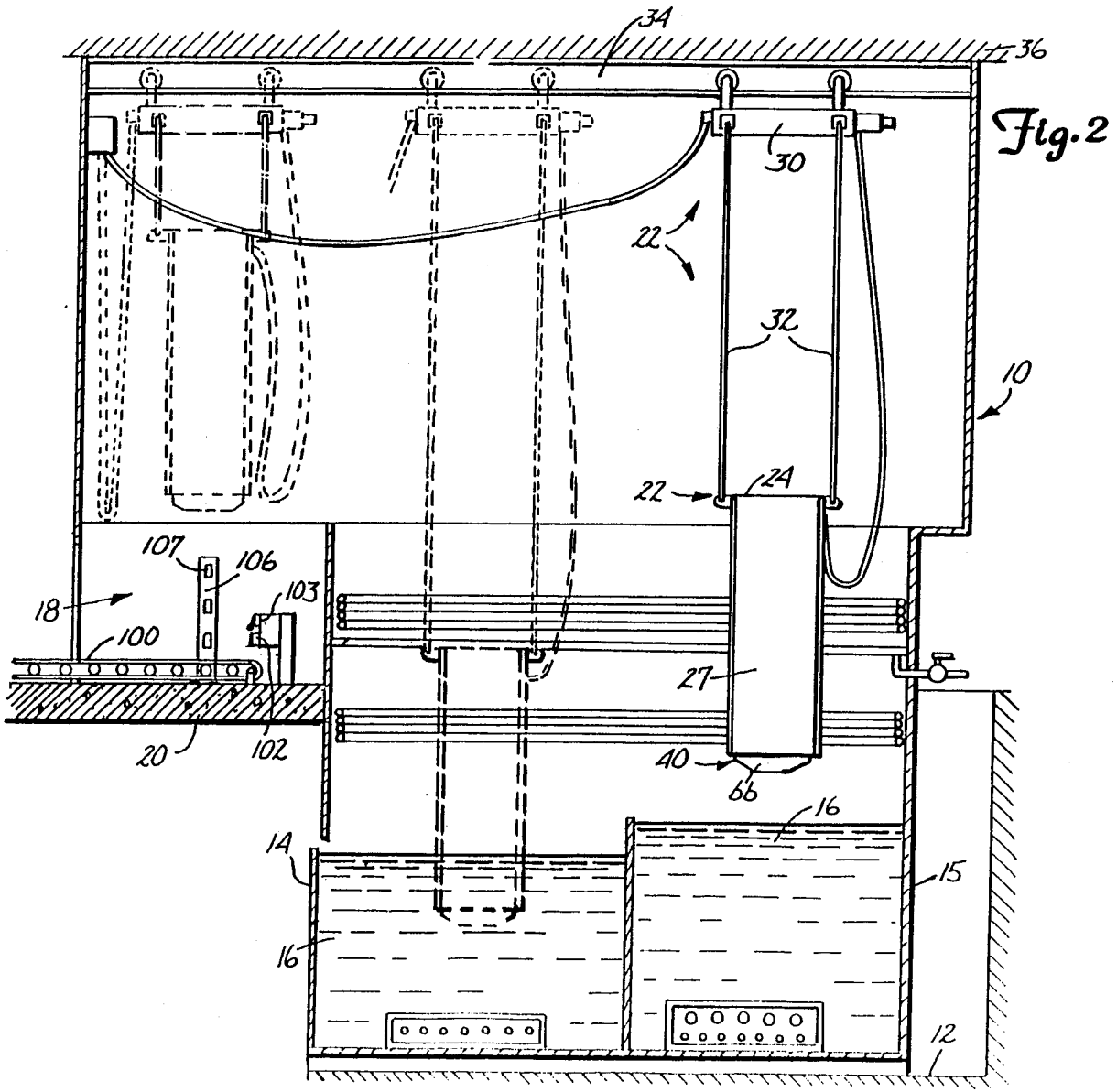
FIG. 2 is a side elevational view of the stae assembly including the rotatable carrier of FIG. 1 in working relationship to a treatment tank; the stage assembly and carrier being shown in full lines in position over a first of two vats of the tank, and being shown twice in dotted lines (1) with the rotating carrier and basket within a second vat, and (2) with the stage assembly and carrier in position over a loading and unloading station.

Forming no part of the invention per se is the means for transporting the container or basket 42 from a position to the left of the loading and unloading station 18 in FIG. 2 to position at that loading station as seen in FIGS. 1 and 5. Any usual or preferred means can be utilized to bring the basket or container 42 to the position as seen in FIGS. 1 and 5. By way of example, an endless conveyor belt 100 is supported on appropriate rollers as seen in FIGS. 1, 2, 4 and 5, and an appropriate stop means or bumper 102 is provided to stop the movement of the container or basket 42 along the conveyor belt when the basket is precisely in line with the carrier as most clearly seen in FIG. 5. A first microswitch 103 or the like is provided to sense the arrival of the container or basket 42 at this aligned position.

OPERATION

The conveyor or basket 42, loaded with work product to be processed and tumbled, is placed on the endless conveyor belt 100 and the conveyor belt drive (not shown) is activated to carry the basket into position inside of the carrier 40 and directly under the basekt cover 76 where the first microswitch 103 will be activated to stop the drive of the conveyor belt and to initiate action of the elevator lines 32,32 to cause the stage assembly to be elevated from the position as seen in FIG. 1 toward the position as seen in FIGS. 4 and 5. When the position of the basket 42 on the basket wedges 84,84 is achieved to firmly position the basket with respect to the feet 66,66, the first vertical stage assembly leg 26 will come into clearing relation with respect to a second microswitch 105 mounted on a vertical wall or switch stanchion 106. As this microswitch 105 goes from the contacted position as seen in FIG. 1 to the released position as seen in FIG. 4, it will initiate action of the basket cover drive motor 90, while the elevator lines 32 continue to move the stage assembly in upward direction.

Figure 6:
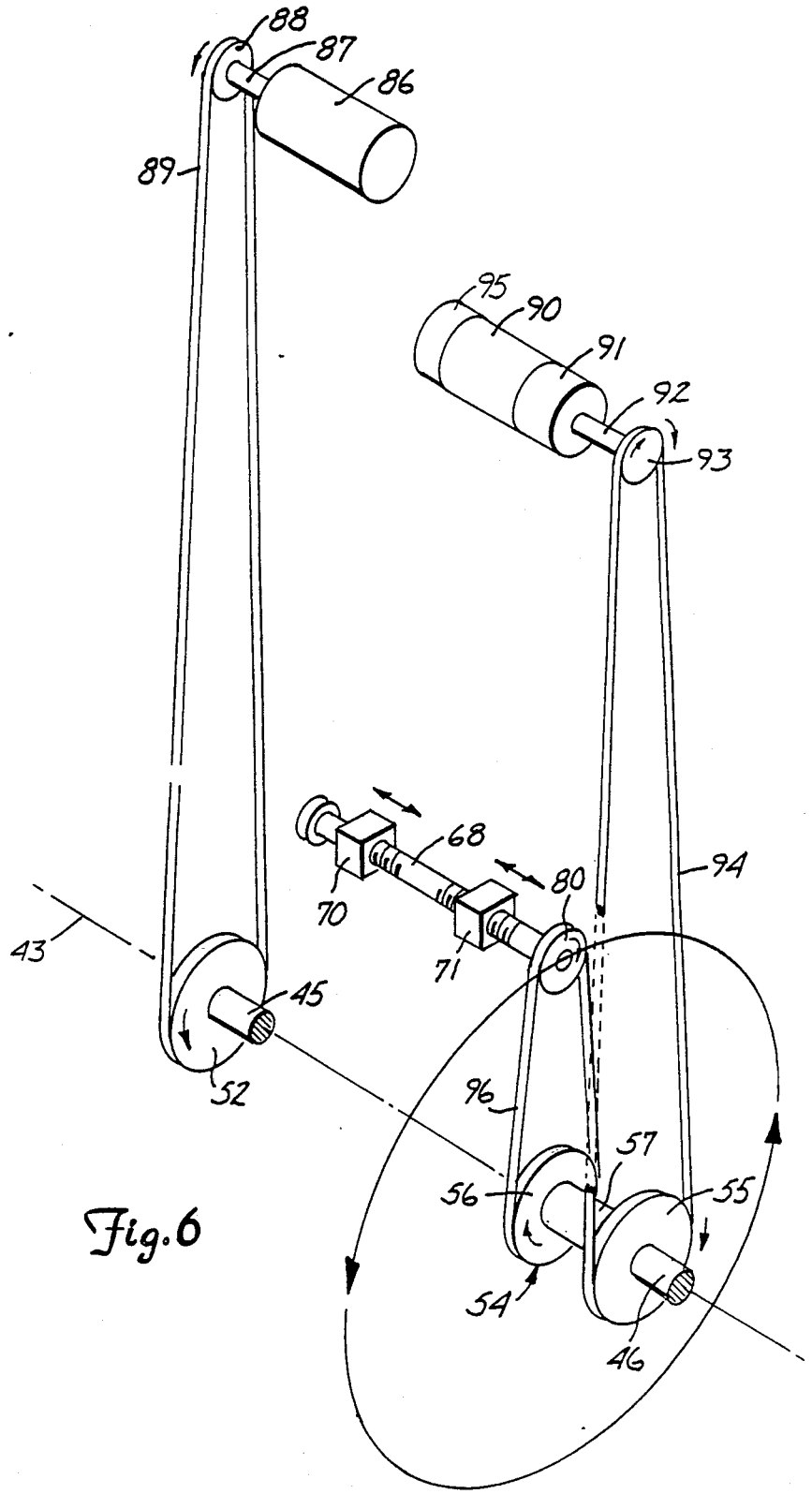
FIG. 6 is a schematic perspective view of a carrier rotation drive motor, carrier mounting shaft means and a drive train between them shown in relationship to a basket cover drive motor, brake and clutch, a double-acting lead screw shaft and a drive train between them.

The basket cover drive motor, acting through its drive train, will cause the double-acting lead screw shaft 68 to rotate in a first angular direction to cause the trunnion-nut assembles 70 and 71 to move toward each other, causing the four clamp links 74 to move the cover 76 from position as seen in FIG. 1 in clearing relation to the basket 42 to position as seen in FIGS. 4 and 5 with the cover 76 firmly clamped down on the top of the basket 42. After this has been accomplished, the first stage assembly leg 26 will come into clearing relationship with yet a third microswitch 107 also mounted on the wall 106, and movement of that microswitch from its contacted to its released position will institute activation of the carrier rotation drive motor 86 which, acting through its drive train, will start rotation of the carrier 40 in a counterclockwise direction as seen in FIGS. 5 and 6.

Once carrier rotation is started, motor 90 will be deactivated and brake 95 will be set, locking the motor against rotation. This tends to prevent rotation of intermediate lead screw drive sprocket means 54 with respect to the pillow blocks 48, for example. But the double-acting lead screw shaft 68 is rotating (with carrier 40) about the carrier rotation axis 43 and is carrying lead screw driven sprocket 80 with it. This forces lead screw drive sprocket 56 and its integral partner cover motor driven sprocket 55 to rotate in a counterclockwise direction as seen in FIG. 6. This movement is transmitted through first cover drive chain 94 to rotate sprocket 93 and drive shaft 92 in counterclockwise direction as seen in that figure. The motion is accommodated by slip clutch 91 which slips but maintains a predetermined loading or drag on the drive train, continuing the positive force locking the cover down against the container or basket 42.

A fourth microswitch 109 is positioned above the third microswitch on the vertical wall 106, and when it comes into clearing relationship with respect to the first stage assembly leg 26, it will transmit a signal to the control center (not specifically shown) to initiate any usual or desired program of processing the workpieces in the conveyor or basket 42 in any usual or preferred manner, for example, in the manner set out in the aforementioned U.S. Pat. No. 3,896,829. During this processing, the carrier 40 will continue to rotate.

After the prescribed treatment on the tumbling workpieces has been performed, and as the carrier and container continue to rotate, all liquids within the container will have had an opportunity to pass back into one of the vats 14 or 15. The stage assembly will again take the position as seen in dotted lines far to the left in FIG. 2 and the regular programming of the work processing will be completed with the initiation of an unwinding of the elevator lines 32,32 bringing the first vertical stage assembly leg 22 back into contacting relationship with respect to the fourth microswitch 109.

This can put at least one of the circuits of the third microswitch through a fifth microswitch 111 which is mounted at the top of the first stage assembly leg 26. As the stage assembly moves downward, the third microswitch 107 will be contacted. A carrier stop control rod 112 is mounted to rotate about its elongated shank with respect to a support bracket 113 which is mounted on the inside of the first stage assembly leg 26. A carrier rotation stop cam 114 extends upwardly from the hood or top wall 62 of the carrier. A lower control finger 116 extends at right angles from the rod 112, and an upper control finger 117 extends at right angles from that rod. The carrier stop control rod 112 is biased to tend to have its lower finger 116 extend out in normal relation to the plane of the first vertical stage assembly leg 26.

When the carrier rotation stop cam 114 hits lower finger 116, the upper finger 117 will contact the operating arm of the fifth microswitch 111 interrupting the circuit through the third switch 107 to the carrier rotation drive motor 86 to cause the carrier to stop in the position as seen in FIGS. 4 and 5. Then, as soon as the second microswitch 105 is contacted by the leg 26 on its way down, the drive motor brake 95 will be deactivated and the basket cover drive motor 90 will be activated in an opposite direction to cause the double-acting lead screw shaft 68 to rotate in a second angular direction to cause the cover to be unclamped and to be elevated from the position as seen in FIG. 4 to the position as seen in FIG. 1.

As the elevator lines 32 continue to lower the carrier 40 and the basket 42, first microswitch 103 will again be contacted, and this can initiate drive of the conveyor belt 100 in a reverse direction so that as the box-like transversely extending feet 66,66 of the carrier reach the ground floor 20, the basket 42 will be clear of the carrier 40, and the conveyor belt 100 will carry it away from the loading and unloading station 18 where a new basket 42 filled with unprocessed workpieces can be substituted for the processed basket on the conveyor 100, the conveyor reversed, and the process repeated.

Although the present invention has been described with reference to preferred embodiments, workers skilled in the art will recognize that changes may be made in form and detail without departing from the spirit and scope of the invention.

What is claimed is:

1. In a stage assembly having two parallel legs, a carrier rotatably mounted with respect to those legs on a carrier rotation axis, the carrier encompassing an open top container containing at least one workpiece to be tumbled and processed, and apparatus including a container cover supported on the carrier and including carrier rotation drive means supported on the stage assembly; the improvement including:

(a) a cover operating shaft rotatably supported on the carrier to be in parallel, spaced relation to the carrier rotation axis;

(b) means supporting said container cover on the carrier for movement between a first closed position in closing relation to the top of said container and a second open positon in spaced relation to the container;

(c) means for moving the container cover between the first closed and the second open positions responsive to rotation of the cover operating shaft in a first angular direction and in a second angular direction, respectively;

(d) said container cover moving means including:

(1) container cover drive motor means and a cover motor drive shaft mounted to said stage assembly, and (2) a drive train between said cover motor drive shaft and said cover operating shaft including intermediate cover operating drive means concentrically mounted with respect to the carrier rotation axis; and (e) said container cover drive motor means being operable to rotate said cover motor drive shaft in direction to rotate said cover operating shaft in said first angular direction to move the container cover toward its closed position and in said second angular direction to move the container cover toward its open position.

2. The apparatus of claim 1 wherein:

(f) the container cover motor drive means includes a container cover drive motor and a slop clutch between the drive motor and the cover operating shaft; and (g) the slip clutch is operative, during rotation of the carrier, to continue to apply torque to the cover operating shaft even after the cover has reached the mechanical limit of its movement.

3. The apparatus of claim 2 wherein:

(h) the container cover motor drive means includes a cover drive motor brake operative when the cover is in its first closed condition and the carrier is rotating to lock the cover drive motor against rotation.

4. In a stage assembly having two parallel legs, an carrier rotatably mounted with respect to those legs on a carrier rotation axis, the carrier encompassing an open top container containing a plurality of workpieces to be tumbled and processed, and apparatus including a container cover supported on the carrier and including carrier rotation drive means supported on the stage assembly; the improvement including:

(a) a double-acting lead screw shaft rotatably supported on the carrier to be in parallel, spaced relation to the carrier rotation axis;

(b) means supprting said container cover in the carrier for movement between a first closed position in closing relation to the top of said container and a second open position in spaced relation to the container;

(c) means for moving the container cover between the first closed and second open positions responsive to the rotation of the lead screw shaft in a first angular direction and in a second angular direction, respectively;

(d) said container cover moving means including:

(1) container cover drive motor means and a cover motor drive shaft mounted to said stage assembly, and (2) a drive train between said cover motor drive shaft and said lead screw shaft including intermediate lead screw drive means concentrically mounted with respect to the carrier rotation axis; and (e) said container cover drive motor means being operable to rotate said motor drive shaft in direction to rotate said lead screw shaft in said first angular direction to move the container cover toward its closed position and in a second angular direction to move the container cover toward its open position.

5. The apparatus of claim 4 wherein:

(f) the container cover drive motor means includes a container cover drive motor and a slip clutch between the drive motor and the lead screw shaft; and (g) the slip clutch is operative, during rotation of the carrier, to continue to apply torque to the lead screw shaft even after the cover has reached the mechanical limit of its movement.

6. The apparatus of claim 5 wherein:

(h) the means for moving the container cover between first closed and second open positions responsive to rotation of the double-acting lead screw shaft includes trunnion-nut assemblies rotatably mounted on the left-hand threads and right-hand threads of the double-acting lead screw shaft; and (i) clamp links each pivotably mounted between one of the trunnion-nut assemblies and the container cover.

7. The appratus of claim 5 wherein:

(h) the carrier is rotatably mounted on the carrier rotation axis on carrier mounting shaft means, said means including a first stub shaft extending outwardly from a first side of the carrier and rotatably mounted with respect to a first of two parallel legs of the stage assembly, and a second stub shaft extending outwardly from a second side of the carrier and rotatably mounted with respect to a second of the stage assembly legs;

(i) the intermediate lead screw drive means includes a cover motor driven sprocket integral and concentric with a lead screw drive sprocket; and (j) the drive train between the cover motor drive shaft and the lead screw shaft includes a first cover drive sprocket mounted on the cover motor drive shaft, the cover motor driven sprocket and lead screw drive sprocket freely rotatably mounted on the carrier mounting shaft means, a lead screw driven sprocket fixedly mounted on the lead screw shaft, a first cover drive belt running on the first cover drive sprocket and the cover motor driven sprocket, and a second cover drive belt running on the lead screw drive sprocket and the lead screw driven sprocket.

8. The apparatus of claim 7 wherein:

(k) the intermediate lead screw drive means is freely rotatably mounted on the second stub shaft; and (l) the carrier rotation drive means includes a carrier rotation drive motor and carrier rotation drive shaft mounted on the stage assembly, a carrier rotation drive sprocket on the carrier rotation drive shaft, a carrier rotation driven sprocket concentric with and keyed to the first stub shaft, and a carrier rotation drive belt running on the carrier rotation drive sprocket and the carrier rotation driven shaft.

9. The apparatus of claim 5 wherein:

(h) the container cover motor drive means includes a cover drive motor brake operative when the cover is in its first closed condition and the carrier is rotating to lock the cover drive motor against rotation.

10. The apparatus of claim 9 wherein:

(i) the means for moving the container cover between first closed and second open positions responsive to rotation of the double-acting lead screw shaft includes trunnion-nut assemblies rotatably mounted on the left-hand threads and right-hand threads of the double-acting lead screw shaft; and (j) clamp links each pivotably mounted between one of the trunnion-nut assemblies and the container cover.

11. The apparatus of claim 9 wherein:

(i) the carrier is rotatably mounted on the carrier rotation axis on carrier mounting shaft means, said means including a first stub shaft extending outwardly from a first side of the carrier and rotatably mounted with respect to a first of the two parallel legs of the stage assembly, and a second stub shaft extending outwardly from a second side of the carrier and rotatably mounted with respect to a second of the stage assembly legs;

(j) the intermediate lead screw drive means includes a cover motor driven sprocket integral and concentric with a lead screw drive sprocket; and (k) the drive train between the cover motor drive shaft and the lead screw shaft includes a first cover drive sprocket mounted on the cover motor drive shaft, the cover motor driven sprocket freely rotatably mounted on the carrier mounting shaft means, a lead screw driven sprocket fixedly mounted on the lead screw shaft, a first cover drive belt running on the first cover drive sprocket and the cover motor driven sprocket, and a second cover drive belt running on the lead screw drive sprocket and the lead screw driven sprocket.

12. The apparatus of claim 11 wherein:

(l) the intermediate lead screw drive means is freely rotatably mounted on the second stub shaft; and (m) the carrier rotation drive means includes a carrier rotation drive motor and carrier rotation drive shaft mounted on the stage assembly, a carrier rotation drive sprocket on the carrier rotation drive shaft, a carrier rotation driven sprocket concentric with and keyed to the first stub shaft, and a carrier rotation drive belt running on the carrier rotation drive sprocket and the carrier rotation driven shaft.

* * * * *

UNITED STATES PATENT AND TRADEMARK OFFICE

CERTIFICATE OF CORRECTION

PATENT NO. : 4,753,255

DATED : June 28, 1988

INVENTOR(S) : Gerald W. Melin

It is certified that error appears in the above-identified patent and that said Letters Patent is hereby corrected as shown below:

Column 7, line 23, delete "positon" and insert --position--; line 48, delete "slop" and insert --slip--.

Column 8, line 4, delete "supprting" and insert --supporting--; line 24, after "said", insert --cover--; line 55, after "of", insert --the--.

Column 10, line 16, after "sprocket", insert --and lead screw drive sprocket--.

Signed and Sealed this

Twenty-ninth Day of November, 1988

*Attest:*

DONALD J. QUIGG

*Attesting Officer*

*Commissioner of Patents and Trademarks*